US006647124B1

(12) United States Patent
Peng

(10) Patent No.: US 6,647,124 B1
(45) Date of Patent: Nov. 11, 2003

(54) LOUDSPEAKER WITH COAXIAL MAGNETIC CIRCUIT FOR HIGH-PITCH SOUND AND LOW-PITCH SOUND

(75) Inventor: Jack Peng, Chung Li (TW)

(73) Assignee: Meiloon Industrial Co., Ltd., Taipei (TW)

( * ) Notice: Subject to any disclaimer, the term of this patent is extended or adjusted under 35 U.S.C. 154(b) by 0 days.

(21) Appl. No.: 10/138,263

(22) Filed: May 6, 2002

(51) Int. Cl.[7] ..... H04R 1/00; H04R 11/02; H04R 9/06

(52) U.S. Cl. ..... 381/412

(58) Field of Search ..... 381/416, 182, 381/412, 420, 396, 401, 402, 419

(56) References Cited

U.S. PATENT DOCUMENTS 5,898,786 A * 4/1999 Geisenberger ..... 381/416

* cited by examiner

*Primary Examiner*—Sinh Tran

(74) *Attorney, Agent, or Firm*—Troxell Law Office PLLC

(57) ABSTRACT

The invention comprises a supporting stand provided with an enlarged opening in a front and a damper in a rear for adhering to the sound coil. A magnetic circuit supported by a cylinder and connecting to the supporting stand and both ends of the magnetic circuit are provided with movement-accommodating space; first sound coil provided in the movement-accommodating space on one end of the space on the other end of the magnetic circuit; first diaphragm provided in an inner rim of the enlarged opening and adhering to the first sound coil; and second diaphragm provided in the inner rim of magnetic circuit; first diaphragm provided in an inner sound coil. Thereby allowing the magnetic circuit to be installed in front of the supporting stand; and thus high-pitch sound and low-pitch sound simultaneously output from a single device.

4 Claims, 6 Drawing Sheets

LOUDSPEAKER WITH COAXIAL MAGNETIC CIRCUIT FOR HIGH-PITCH SOUND AND LOW-PITCH SOUND

BACKGROUND OF THE INVENTION

1. Field of the Invention

The present invention relates to an improvement of loudspeaker, especially referring to a unitary structure of loudspeaker provided with single magnetic circuit that outputs both high-pitch sound and low-pitch sound.

2. Description of the Prior Art

The audio equipment has become an indispensable entertainment device to relax human's minds since its invention. The merry melodies not only enriches human's lives, but has also prospered human's communities and a number of related industries. Loudspeakers have been improved continually due to the growing demands in the market. In an effort to increase market shares, the manufacturers research new models and improve the sound performance and introduce new models of loudspeakers to the market periodically.

As shown by FIG. 1, the conventional loudspeaker comprises a supporting stand A1 provided with an enlarged opening A11 in the front and a magnetic circuit A12 in the rear; a sound coil A2 provided in the center of the magnetic circuit A12; a damper A3 adhering to the sound coil A2; and a diaphragm A4 provided in the enlarged opening A11 with its inner rim adhering to the sound coil A2.

The magnetic circuit A12 is provided in the most rear area of the loudspeaker that allows the unitary sound coil A2 to divide the magnetic field; thereby facilitates the diaphragm A4 to produce sounds. However, loudspeakers produce sounds in a certain range of bandwidths. Therefore, manufacturers have to install a high-pitch loudspeaker and a low-pitch loudspeaker in the audio device. Consequently, costs increase and the loudspeaker occupies larger space.

SUMMARY OF THE INVENTION

The present invention comprises a unitary magnetic circuit to output both high-pitch sound and low-pitch sound simultaneously.

The present invention is provided with a supporting stand with an enlarged opening in the front and a damper in the rear for adhering to the sound coil, a magnetic circuit supported by a cylinder and connecting to the supporting stand and both ends of the magnetic circuit are provided with movement-accommodating space, first sound coil provided in the movement-accommodating space on one end of the magnetic circuit, second sound coil provided in the movement accommodating space on the other end of the magnetic circuit, first diaphragm provided in the enlarged opening with its inner rim adhering to first sound coil, and second diaphragm provided in the inner rim of the magnetic circuit and adhering to the second sound coil; thereby allows the magnetic circuit to be installed in front of the supporting stand and, therefore, the unitary structure outputs both high-pitch sound and low-pitch sound simultaneously.

The present invention will be apparent in its contents of technique after reading the detailed description of the preferred embodiments of the present invention in reference to the accompanying drawings, wherein:

DETAILED DESCRIPTION OF THE PREFERRED EMBODIMENT

Figure 1:
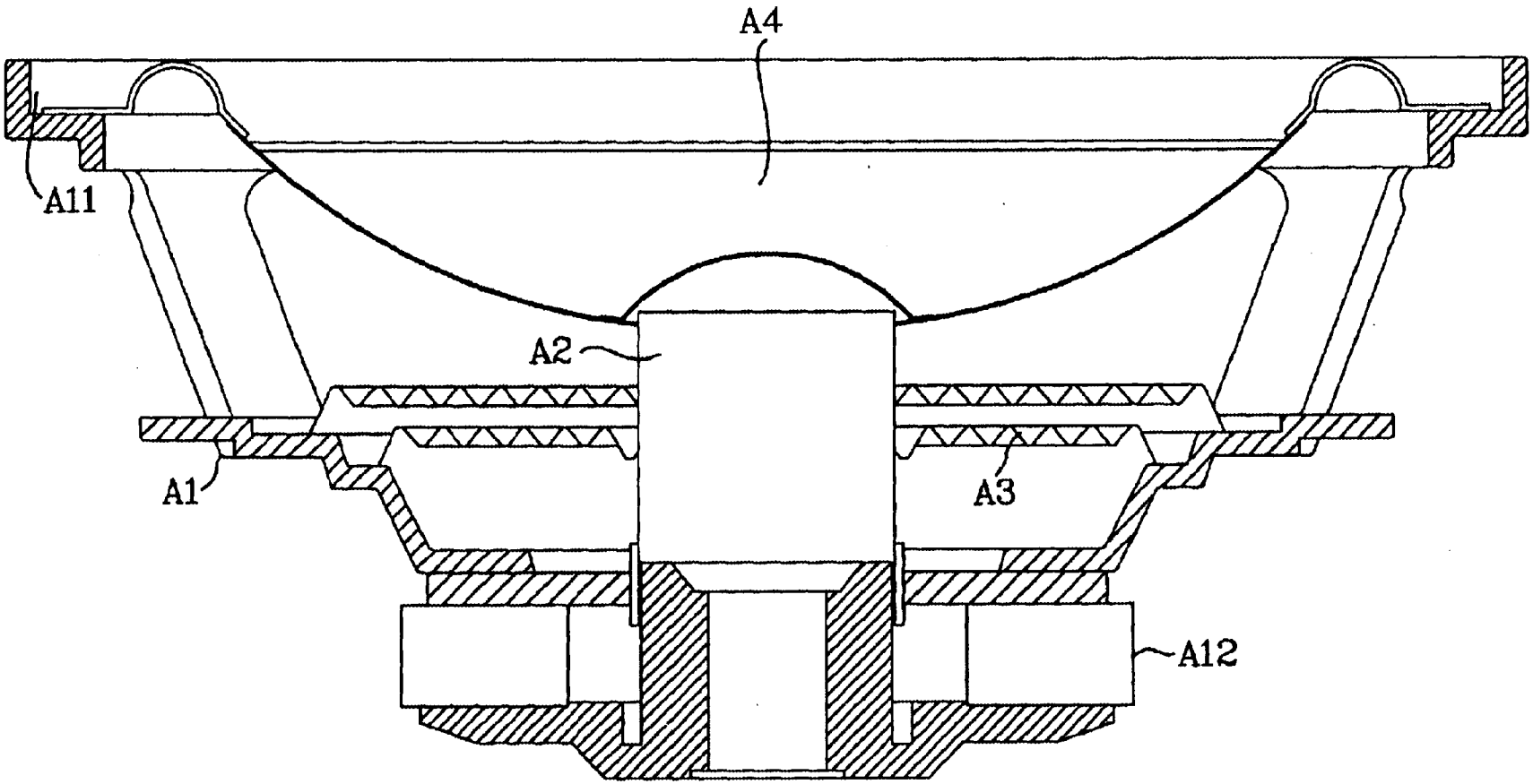
FIG. 1 PRIOR ART
FIG. 1 is a plain view showing the structure of conventional loudspeaker.

As shown by FIGS. 2~6, the structure of loudspeaker with coaxial magnetic circuit for high-pitch sound and low pitch sound comprises the components as follows:

- a supporting stand 1 provided with an enlarged opening 11 in the front and a damper 3 in the rear for adhering to sound coil 2;
- a magnetic circuit 5 supported by cylinder 4 and connecting to supporting stand 1; Both ends of magnetic circuit 5 are provided with movement-accommodating spaces 51, 52;
- first sound coil 2 provided in the movement-accommodating space 51 on one end of magnetic circuit5;
- second sound coil 6 provided in the movement-accommodating space 52 on the other end of magnetic circuit 5;
- first diaphragm 7 provided in the enlarged opening 11 with its inner rim adhering to first sound coil 2; and
- second diaphragm 8 provided in the magnetic circuit 5 with its inner rim adhering to second sound coil 6.

Therefore, the magnetic circuit 5 can be installed in front of the supporting stand 1 and the unitary structure provides the magnetic circuit to output both high-pitch sound and low-pitch sound simultaneously.

Figure 2:
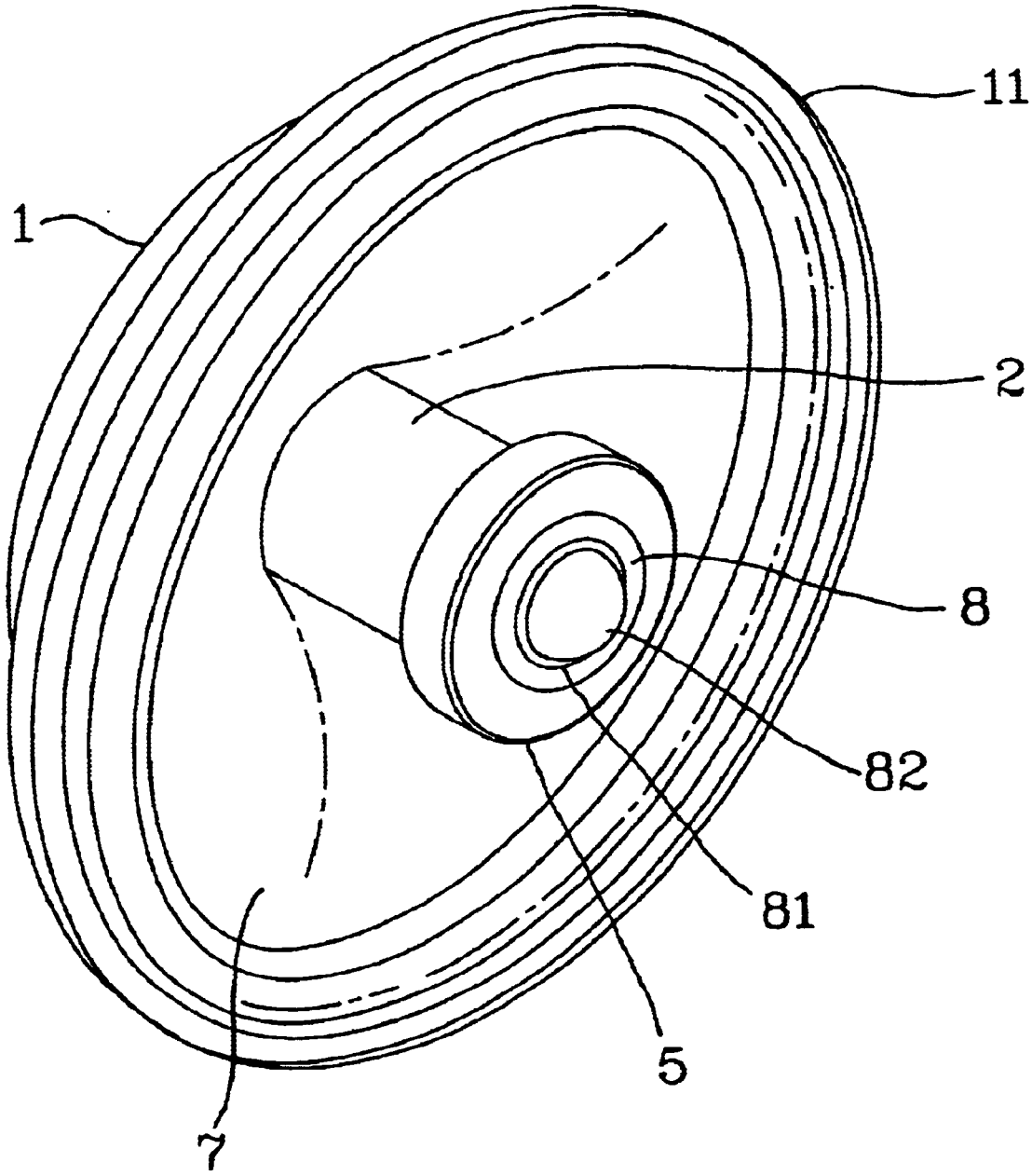
FIG. 2 is an external view of present invention.
Figure 3:
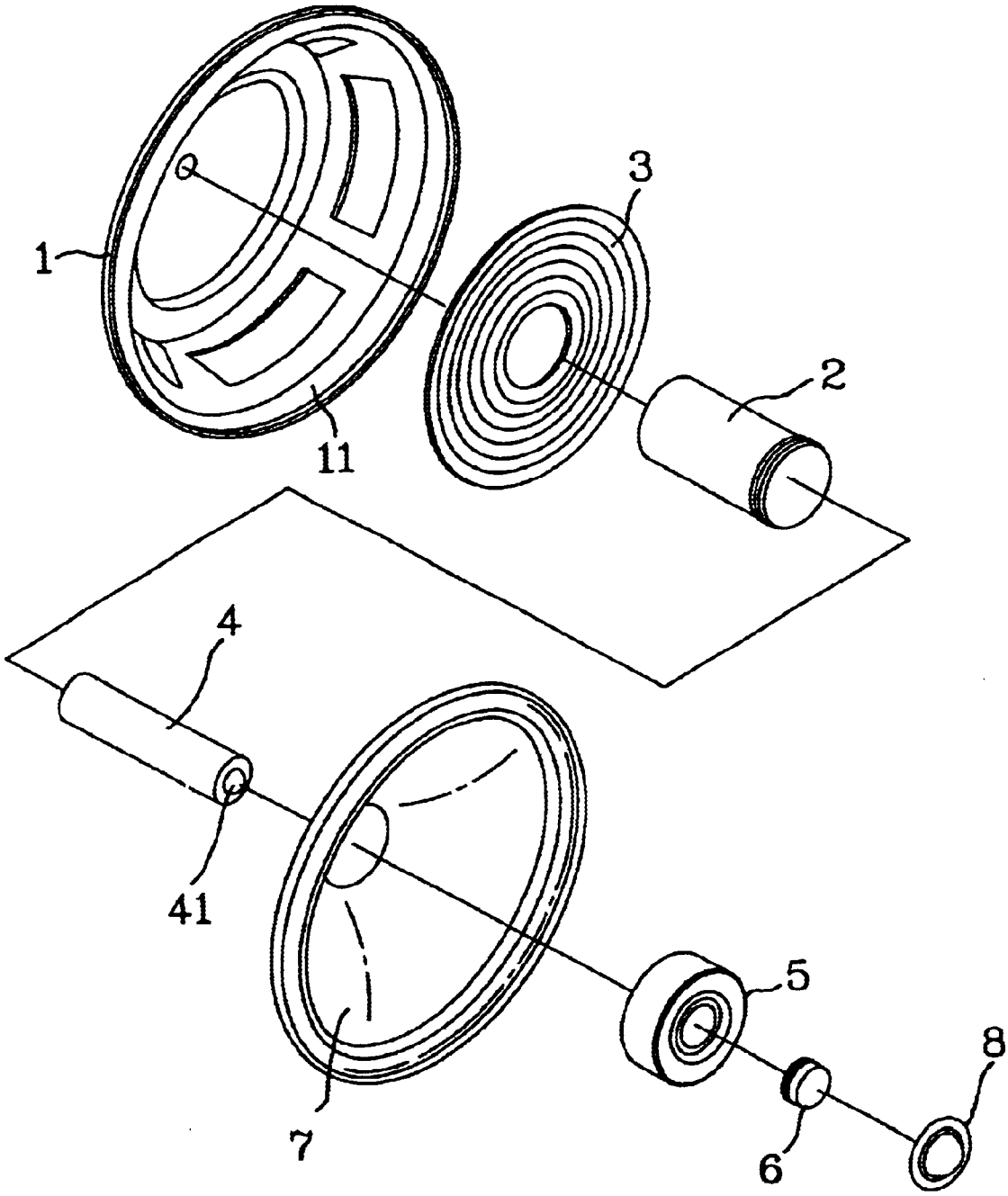
FIG. 3 is a stereoscopic drawing of present invention.

As shown by FIGS. 2 and 3, a bowl with a hole in the center is provided in the first diaphragm 7 as low-pitch diaphragm; and a ring 81 surrounding the round convex 82 is provided in the second diaphragm 8 as high-pitch diaphragm.

First sound coil 2 differs from second sound coil 6 with respect to diameter and length. The magnetic circuit 5 comprises a reverse T-shaped cap 53 covered by external cover 54 provided with various sizes of holes on both ends and contains ring-shaped magnet 55 inside; and thus the movement-accommodating spaces 51 & 52 are created when the external cover 54 covers the cap 53.

Tiny holes are provided in the movement-accommodating space 52 on the external cover 54; and concave 56 is provided along the center to facilitate the assembly of second diaphragm 8; thereby keeps the edge underneath and prevents the loudspeaker from being torn apart. A conoid hole 57 is provided under the cap 53 and a conoid convex 41 is provided in the upper area of the cylinder 4 to suit the foresaid conoid hole 57. These components can be glued, punched, even screwed together. The cylinder 4 is longer than the first sound coil 2 and connects to the supporting stand 1 on the other end; and thus the first sound coil 2 wraps the cylinder 4 and the side edge connects to the damper 3 when these components are assembled.

Figure 4:
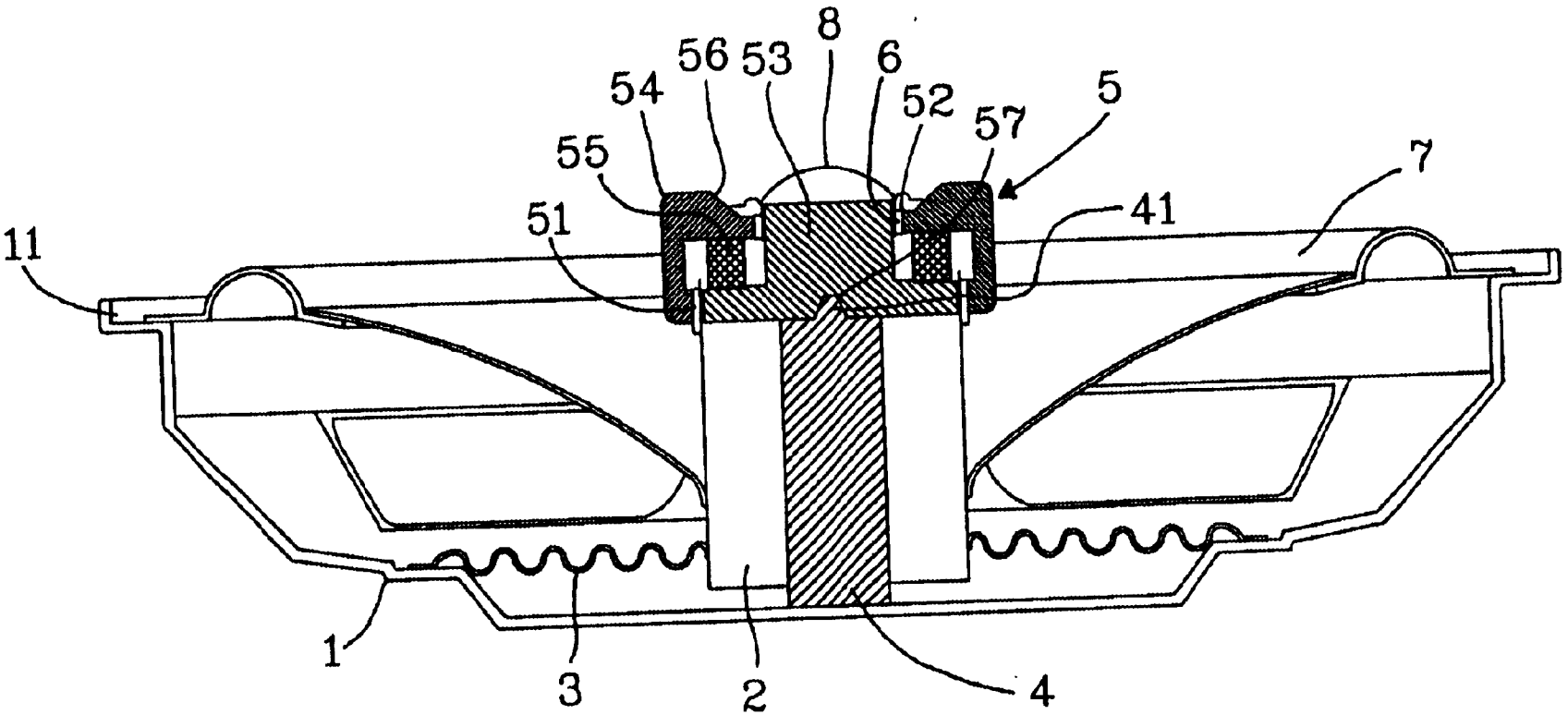
FIG. 4 is a plain view showing the structure of present invention.
Figure 5:
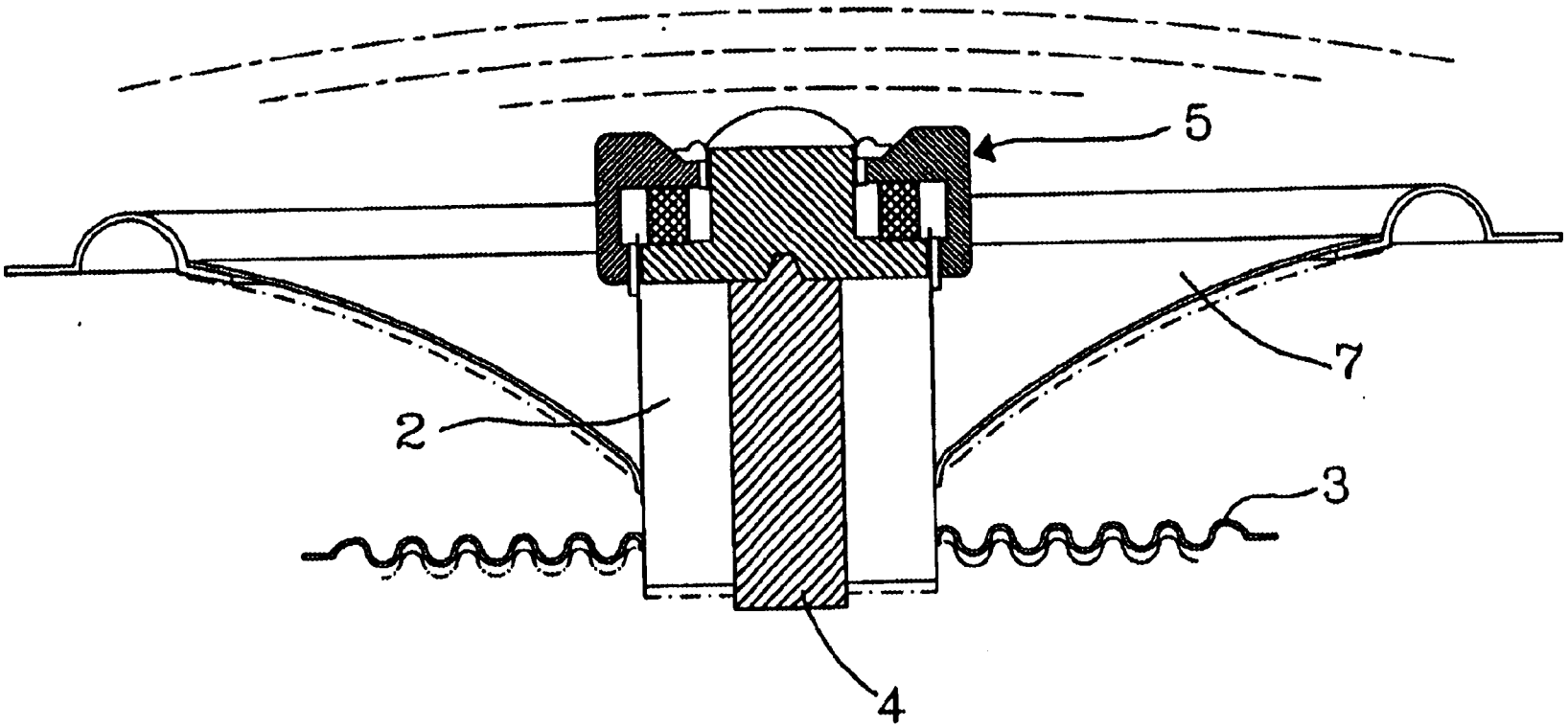
FIG. 5 is a schematic view showing the motion of the low-pitch diaphragm of present invention.
Figure 6:
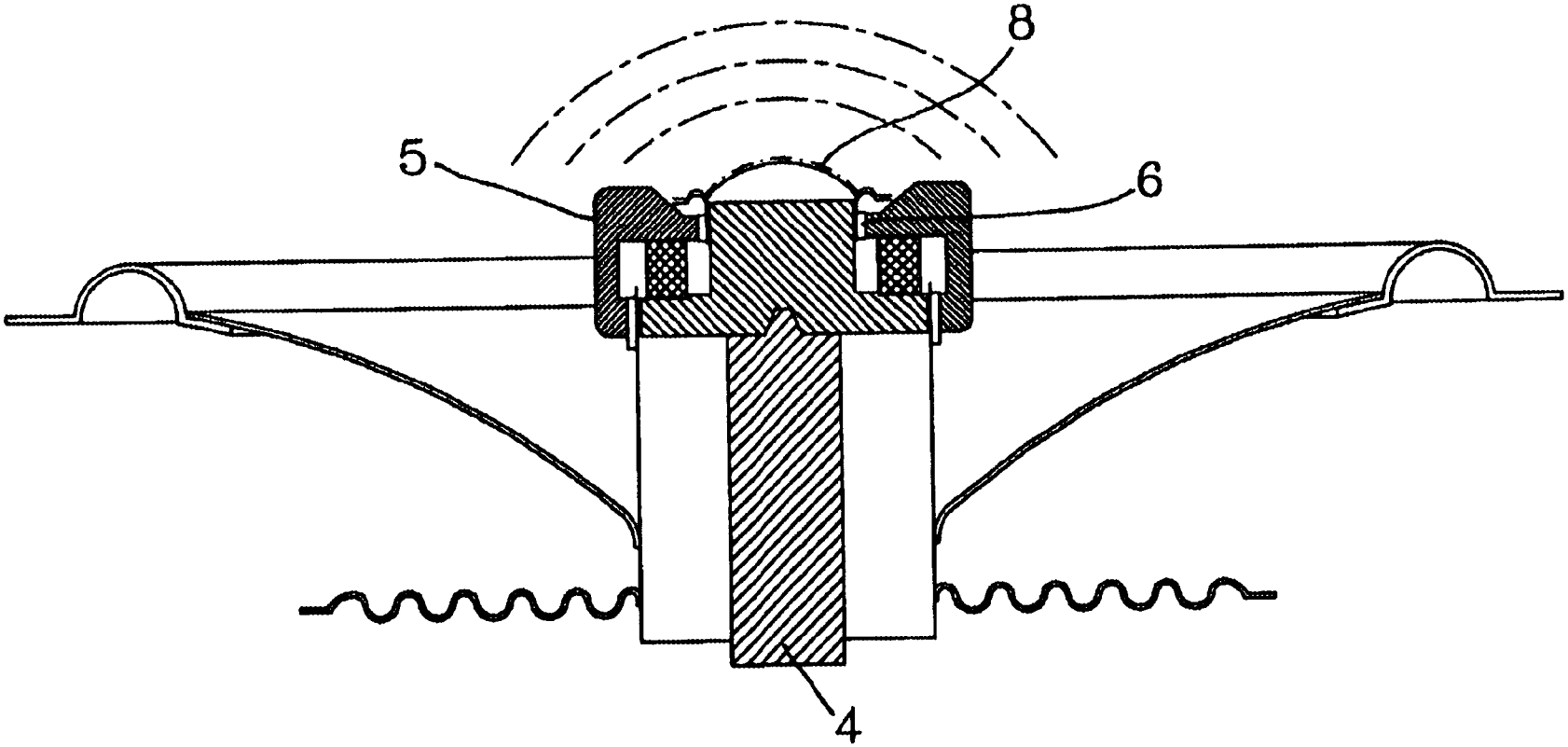
FIG. 6 is a schematic view showing the motion of the high-pitch diaphragm of present invention.

As shown by FIGS. 4, 5 and 6, the magnetic circuit 5 can be installed in front of the supporting stand 1. When pushing the second sound coil 6 and the first sound coil 2, the first sound coil 2 triggers the first diaphragm 7 to produce low-pitch sound and the second sound coil 6 triggers the second diaphragm 8 to produce high-pitch sound; thereby outputs both high-pitch sound and low-pitch sound from a single loudspeaker.

As described in preceding paragraphs, the present invention allows a single loudspeaker to output both high-pitch sound and low-pitch sound; does not require the additional supporting stand and a magnetic circuit as opposed to the conventional loudspeaker; and needs less space in assembly than the conventional loudspeaker does. The present invention is a breakthrough with respect to design and performance.

Having thus described my invention, what the inventor claims as new and desire to be secured by Letters Patent of the United States include:

1. A loudspeaker with coaxial magnetic circuit for high-pitch sound and low pitch sound comprising:

a) a supporting stand having a enlarged opening on a front;

b) a damper connected to a rear of the supporting stand;

c) a magnetic circuit having a T-shaped cap, an external cover covering the T-shaped cap and a ring shaped magnet connected between the T-shaped cap and the external cover, a first movement accommodating space and a second movement accommodating space are formed between the external cover and the T-shaped cap;

d) a first sound coil connected to the damper on an outer circumference of a first end, and a second end of the first sound coil located within the first movement accommodating space;

e) a cylinder positioned within the first sound coil and connected to the supporting stand at a first end and to the T-shaped cap of the magnetic circuit at a second end;

f) a first diaphragm positioned within enlarged opening of the supporting stand, and connected to the first sound coil and to the supporting stand;

g) a second sound coil located within the second movement accommodating space; and h) a second diaphragm positioned on the magnetic circuit and connected to the second sound coil.

2. The loudspeaker with coaxial magnetic circuit for high-pitch sound and low pitch sound as claimed in claim 1, wherein the T-shaped cap has a conoid shaped hole, and the second end of the cylinder has a conoid shaped extension fitted into the conoid shaped hole of the T-shaped cap to connect the T-shaped cap to the second end of the cylinder.

3. The loudspeaker with coaxial magnetic circuit for high-pitch sound and low pitch sound as claimed in claim 1, wherein the external cover has an inner circumference with a concave edge.

4. The loudspeaker with coaxial magnetic circuit for high-pitch sound and low pitch sound as claimed in claim 1, wherein the cylinder is longer than the first sound coil.

* * * * *